US006015394A

United States Patent [19]

Young

[11] Patent Number: 6,015,394

[45] Date of Patent: Jan. 18, 2000

[54] TISSUE STIMULATION APPARATUS FOR WHEELCHAIRS AND THE LIKE

[76] Inventor: Carol L. Young, 2724 Oliver, Fort Wayne, Ind. 46806

[21] Appl. No.: 08/267,040

[22] Filed: Jun. 27, 1994

[51] Int. Cl.[7] ..... A61H 23/02; A61H 23/04

[52] U.S. Cl. ..... 601/55; 601/56; 601/58; 601/148; 297/DIG. 4

[58] Field of Search ..... 601/148, 149, 601/150, 46, 48, 49, 55, 56, 58; 297/DIG. 4

[56] References Cited

U.S. PATENT DOCUMENTS

| | | | |
|---|---|---|---|
| 742,287 | 10/1903 | Casper | 601/148 |
| 3,721,232 | 3/1973 | Trenchard | 5/348 |
| 4,108,492 | 8/1978 | Kirby | 297/284 |
| 4,115,885 | 9/1978 | Davis | 5/349 |
| 4,258,706 | 3/1981 | Shank | 601/55 |
| 4,370,769 | 2/1983 | Herzig | 5/452 |
| 4,595,212 | 6/1986 | Haury | 297/DIG. 4 |
| 4,610,253 | 9/1986 | Rosenberg | 128/382 |
| 4,643,481 | 2/1987 | Saloff | 297/458 |
| 4,738,486 | 4/1988 | Surber | 297/284 |
| 4,761,011 | 8/1988 | Sereboff | 297/230 |
| 4,838,613 | 6/1989 | Smith | 297/452 |
| 4,890,235 | 12/1989 | Reger | 364/468 |
| 5,072,724 | 12/1991 | Marcus | 601/148 |
| 5,083,551 | 1/1992 | Addison | 297/284 A |
| 5,106,159 | 4/1992 | Iwamoto | 297/416 |
| 5,161,630 | 11/1992 | Garin | 180/65.2 |
| 5,193,237 | 3/1993 | Holdredge | 5/654 |
| 5,314,403 | 5/1994 | Shaw | 601/148 |
| 5,344,437 | 9/1994 | Pistay | 601/58 |

FOREIGN PATENT DOCUMENTS

WO 92/14387 9/1992 WIPO .

*Primary Examiner*—Danton D. DeMille
*Attorney, Agent, or Firm*—Baker & Daniels

[57] ABSTRACT

The present invention involves an apparatus for stimulating skin tissue of a nonambulatory individual in a wheelchair or other mobile apparatus. The pouch of the present invention contains a fluid medium which is connected to an agitator which generates turbulence and disturbances within the fluid medium. For example, a vibrator may be placed adjacent to the pouch and vibrate the fluid medium. These motions are transmitted through the fluid medium to stimulate the skin and underlying tissue which is resting on the pouch. The pouch may be connected to the support bars of a wheelchair, or have arms to extend around and attach to a chair seat in a scooter. A pocket of the pouch serves to hold the agitator in contact with the fluid, e.g., water, so that the fluid is adequately turbulated and disturbed to have a stimulating effect on the body tissue.

15 Claims, 3 Drawing Sheets

TISSUE STIMULATION APPARATUS FOR WHEELCHAIRS AND THE LIKE

BACKGROUND OF THE INVENTION

1. Field of the Invention

The present invention relates to wheelchairs and similar devices for nonambulatory individuals. More particularly, the field of the invention involves devices for preventing or minimizing the occurrence of skin sores on nonambulatory individuals.

2. Description of the Related Art

Skin pressure sores, such as bedsores or decubitus ulcers, are a discomfort for many people who are confined or physically impaired. The sores are portions of an individual's skin which are irritated by the continuous pressure applied by the individual's body on the skin tissue. For individuals without any sensory impairments, the continuous pressure causes discomfort and causes the individual to shift their body and relieve the pressure. In many nonambulatory individuals, e.g., individuals who have a partial or full sensory loss due to vascular or neural damage, the skin tissue affected is unfeeling so that the initial irritation goes unnoticed by the nonambulatory individual. When a particular portion of the skin stays in pressurized contact with a material such as bed linen, that skin tissue may be irritated by the semi-abrasive contact and become inflamed. Such skin sores are slow and difficult to heal, particularly because the nonambulatory individual often does not feel any pain involved with the skin sore and the underlying tissue is not stimulated to heal the damaged tissue.

These skin sores pose a chronic problem for individuals who are confined to their beds because of paralysis or physical impairment. Such nonambulatory individuals typically spend significant amounts of time in wheelchairs and similar devices which provide mobility. The problem of skin sores is often exacerbated when nonambulatory individuals utilize wheelchairs, scooters, and the like. In a wheelchair, certain portions of skin tissue support a greater percentage of the individual's body weight. This additional support creates further pressure on that particular skin tissue, and tends to foster the development of skin sores. Also, as a result of the movement of the wheelchair, the skin tissue may be further aggravated.

Nonambulatory individuals should be repositioned periodically, e.g., every two hours to relieve the pressure on the skin. One common way of reducing the formation of skin sores is to provide additional padding for the affected area of skin to reduce the pressure. However, padding has only a limited ability to absorb pressure, and the effectiveness of padding diminishes over time. Another preventative measure involves periodically moving the nonambulatory individual within the wheelchair to interrupt the continuous application of pressure. This method is problematic for several reasons. Many nonambulatory individuals do not have the ability to move themselves, and thus require another person to move. Also, if such movement is not sufficiently frequent, then portions of the skin tissue may still develop sores. Further, if the individual falls asleep, then that individual could not be moved without disturbing the sleep.

Another known method of deterring the formation of skin sores involves a mechanism embodied in a wheel chair which includes a pressure-sensor with a plurality of individual water filled cells disposed in the seat. Each cell is connected via a tube to cells on a feeling part of the individual's body so that excessive pressure on the buttocks (presumably unfeeling) is communicated to a feeling part of the individual. The pressure in the seat cells is monitored by a processor which may actuate a vibrator on a feeling part of the individual. By activating the vibrator, the presence of excessive pressure is communicated to the individual. Although this device identifies potential problem areas where too much pressure is exerted on the skin tissue, this device still depends of the nonambulatory individual to movie and thereby relieve the pressure.

What is needed is a device which acts to prevent skin sores in nonambulatory individuals using wheel chairs and similar devices.

SUMMARY OF THE INVENTION

The present invention involves a fluid filled pouch attachable to the seat or back of a wheelchair or similar device. The pouch has an associated agitator which causes turbulence and vibrations within the fluid in the pouch. The movement of the fluid interacts with the skin tissue of the individual in the wheelchair, stimulating the skin and underlying tissue thereby inducing greater blood circulation throughout the pressurized skin tissue. The increased blood circulation tends to offset some of the pressure from the body's weight, and also provides blood circulation to the skin tissue which works against the formation of skin sores.

The pouch of the present invention provides a hydrostatic, undulating pressure stimulator for a wheelchair. This stimulator prevents decubitus ulcers and skin breakdown for persons confined to a wheelchair. The stimulator or vibrator causes blood circulation in the area of the skin that the person is unable to move. This stimulates the skin tissue and prevents skin breakdown, decubitus ulcers, and ischemia. Also, the increased circulation deters the occurrence of muscle spasms typically associated with poor circulation.

The pouch may be used in addition to the seat of a wheelchair, but preferably the pouch is formed for attaching to the metal frame of the wheelchair to replace the seat and/or back portion. Additional pouches may be made for the arm rests of the wheelchair. The pouch is made of a suitable material, such as vinyl, and has an interior chamber for containing a fluid, such as water. The pouch may also have a pocket for holding the agitator in contact with the fluid inside the pouch. Alternatively, the agitator may be held against the pouch by another device. In either event, the agitator causes disturbance and vibration in the fluid within the pouch, which beneficially effects the skin tissue contacting the pouch.

The agitator may be an electrically operated vibrator which runs on battery power. Both the battery and vibrator are preferably flat, so that they may be attached to the back side of the seat or back of the wheelchair without protruding outside the general periphery of the wheelchair frame. For a power wheel chair or scooter having a battery driven electric motor, the vibrator may be connected to the motor's battery and thereby avoid having a separate vibrator battery. Alternatively, the agitator may be located within the pouch, e.g., a pump or jacuzzi jet, with its electrical connections extending out of the pouch for suitable connection.

The pouch of the present invention is easily attached to the wheelchair frame. The pouch contains grommets at its edges which may be engaged by pins, rings, or other devices to attach the pouch to the metal bars of the wheel chair frame. Alternatively, the edges of the pouch may have extensions and matching grommets so that the extensions may be looped over the metal bars of the frame and the grommets secured together. For scooters or similar devices having a contoured seat mounted on a spindle, the pouch may have elongate arms on opposite edges which extend around the contoured seat for attachment.

The present invention involves, in one form, a mobile device, such as a wheelchair or scooter, for supporting a nonambulatory individual. The mobile device has at least one support surface upon which the individual rests. A pouch which contains a fluid medium and provides the support surface. An agitating device acts on the fluid medium in the pouch whereby skin tissue of the individual on the support surface is stimulated by the fluid medium to thereby deter the formation of skin sores.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
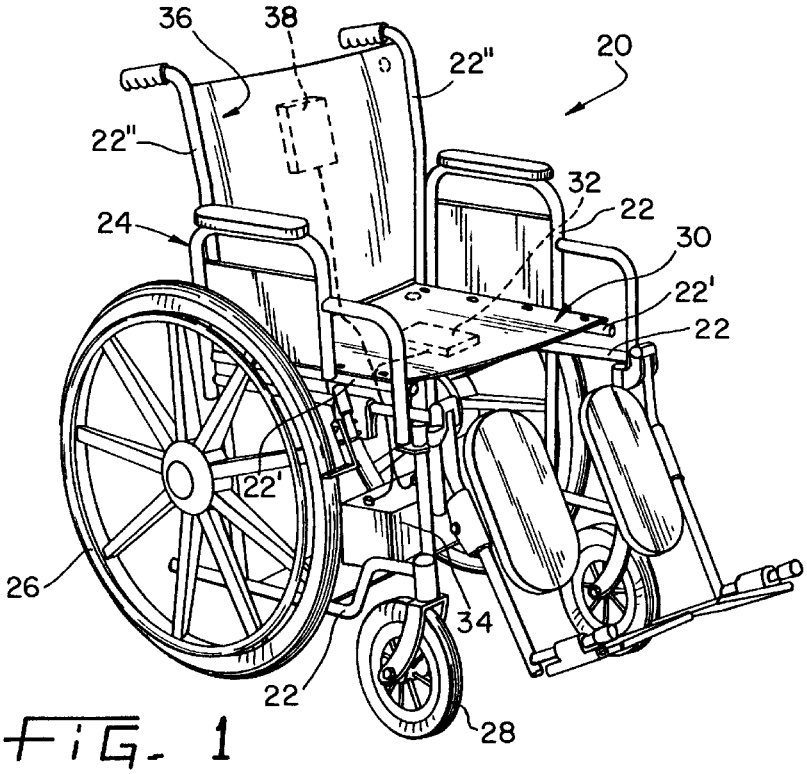
FIG. 1 is a perspective view of a wheelchair having the tissue stimulation apparatus of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates preferred embodiments of the invention, in several forms, and such exemplifications are not to be construed as limiting the scope of the invention in any manner.

DESCRIPTION OF THE PREFERRED EMBODIMENTS

The preferred embodiments disclosed below are not intended to be exhaustive or limit the invention to the precise forms disclosed in the following detailed description. Rather, the embodiments are chosen and described so that others skilled in the art may utilize their teachings.

Figure 2:
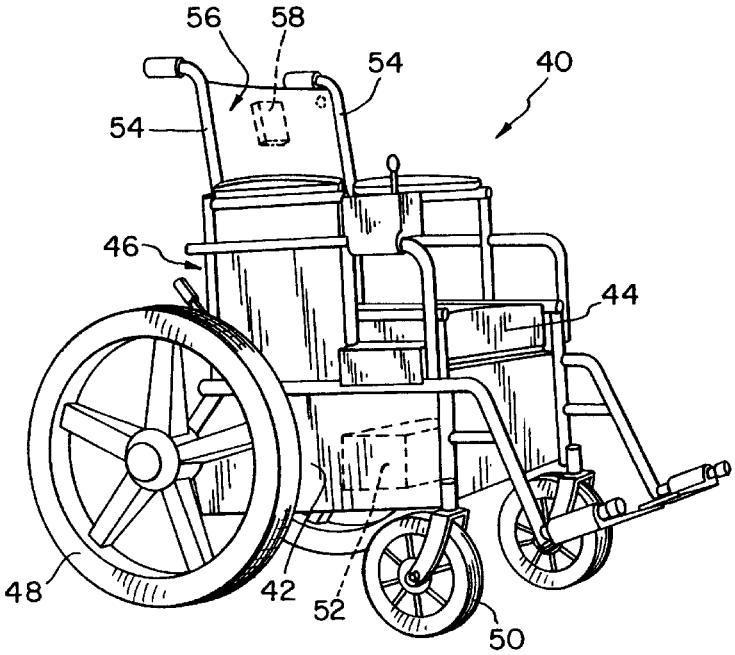
FIG. 2 is a perspective view of a power wheelchair having the tissue stimulation apparatus of the present invention.
Figure 3:
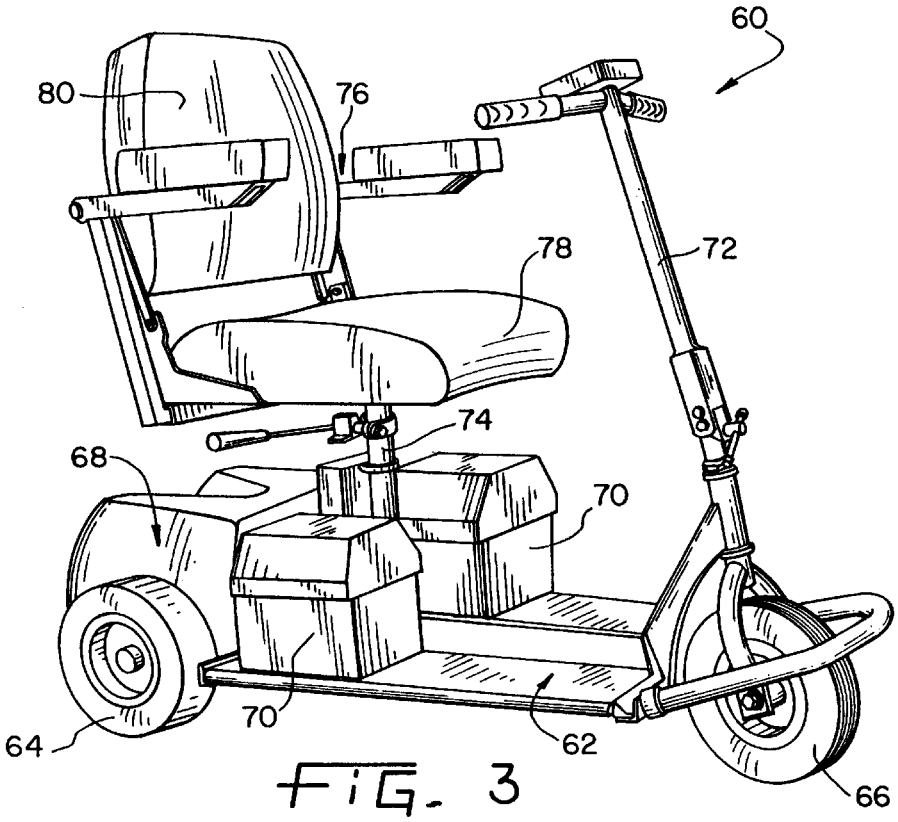
FIG. 3 is a perspective view of a power scooter having the tissue stimulation apparatus of the present invention.

The present invention relates to wheelchairs or scooters used for nonambulatory individuals. FIGS. 1 and 2 show wheelchairs, manual and powered respectively, equipped with the tissue stimulation apparatus of the present invention. FIG. 3 shows a motorized scooter having the inventive apparatus. FIGS. 4–7 show three different embodiments of the invention adapted to be used with a wheelchair or scooter.

FIG. 1 depicts wheelchair 20 having a size and appearance similar to many currently available wheelchairs. Like conventional wheelchairs, wheelchair 20 includes several support bars 22, typically aluminum or steel, which are interconnected to form frame 24. Frame 24 rotatably supports drive wheels 26 and front wheels 28. Support bars 22 are typically made of metal tubes which are capable of supporting the weight of a human body. Other portions of frame 24 may be made of metal, plastic, cloth, or other suitable materials. Particularly relevant to the present invention are seat support bars 22' and back support bars 22".

In accordance with the present invention, seat portion 30 is disposed between seat support bars 22'. Two opposite outer edges of seat portion 30 are structured and arranged to engage support bars 22' as will be described in greater detail in relation to FIGS. 4–7. Seat portion 30 defines an internal cavity which contains a fluid medium, e.g., water, a water solution, or other liquid. The upper surface of seat portion 30 provides a support surface for an individual sitting in wheelchair 20. Vibrator 32 contacts the lower surface of seat portion 30, and is connected to a suitable power source such as battery 34. Vibrator 32 operates to agitate and cause turbulent movement of the fluid within the internal cavity of seat portion 30. The turbulent movement of the fluid medium is transmitted to the upper support surface of seat portion 30 and then to the skin of the individual sitting in wheelchair 20. The agitation may also be provided by other devices such as a rotor or jacuzzi jet disposed within the internal cavity of seat portion 30. This agitation of the fluid medium stimulates circulation within the skin and its underlying tissue, deterring the formation of skin sores.

Similarly arranged between back support bars 22", back portion 36 defines an internal cavity which contains a fluid medium, e.g., water, a water solution, or other liquid. The front surface of back portion 36 provides a support surface for an individual sitting in wheelchair 20. Vibrator 38 contacts the rear surface of back portion 36, and is connected to a suitable power source such as battery 34. Vibrator 38 operates to agitate and cause turbulent movement of the fluid within the internal cavity of back portio 36. The turbulent movement of the fluid medium is transmitted to the front support surface of back portion 36 and then to the skin of the individual sitting in wheelchair 20. The agitation may also be provided by other devices such as a rotor or jacuzzi jet disposed within the internal cavity of back portion 36. This agitation of the fluid medium stimulates circulation within the skin and its underlying tissue, deterring the formation of skin sores.

FIG. 2 depicts power wheelchair 40, which includes electromotor 42 disposed beneath seat 44. Frame 46 rotatably supports drive wheels 48 and front wheels 50. The lower portion of frame 46 contains electromotor 42 and battery 52, while supporting the cushion of seat 44. Bars 54 extend from the lower portion of frame 46 to support back portion 56 having an associated vibrator 58. Vibrator 58 is electrically connected to battery 52. Although minor differences exist between back portion 56 of FIG. 2 and back portion 36 of FIG. 1, both have a similar configuration.

In accordance with another aspect of the present invention, seat 44 defines a fluid containing internal cavity which provides a support surface on its upper face. Rather than being supported at opposite edges, seat 44 comprises a fluid filled cushion and a suitable vibrator disposed upon the planar surface above electromotor 42 and battery 52. While seat 44 is shown in general terms in FIG. 2, the fluid filled cushion may be provided by any of the configurations shown in FIGS. 4–7. Alternatively, the fluid filled cushion of seat 44 may be specially designed for the particular contour of power wheelchair 40. As many different configurations of wheelchair seats exist, seat 44 is shown in general form so as not to limit the application of the present invention.

Another mobile device for supporting a nonambulatory individual, scooter 60, is shown in FIG. 3. Like the previously disclosed wheelchairs, scooter 60 provides a support surface which the nonambulatory individual rests upon during movement of the device. Scooter 60 includes base 62 which rotatably supports drive wheels 64 and front wheel 66. Electromotor 68 and batteries 70 are located on base 62 and provide driving force for drive wheels 64. Steering column 72 extends from front wheel 66 and allows the occupant to guide the direction of scooter 60. Spindle 74 extends from base 62 to support chair 76 over base 62. Chair 76 includes seat portion 78 and back portion 80.

In accordance with another aspect of the present invention, seat 78 defines a fluid containing cavity which provides a support surface on its upper face. Rather than being supported at opposite edges, seat 78 comprises a fluid filled cushion and a suitable vibrator disposed upon or in place of the original seat mounted above spindle 74. While seat 78 is shown in general terms in FIG. 3, the fluid filled cushion may be provided by any of the configurations shown in FIGS. 4–7. Alternatively, the fluid filled cushion of seat 78 may be specially designed for the particular contour of scooter 60. As many different configurations of scooter seats exist, seat 78 is shown in general form so as not to limit the application of the present invention. In a similar fashion, back portion 80 comprises a fluid filled cushion and a suitable vibrator disposed upon or in place of the original back of chair 76.

Figure 4:
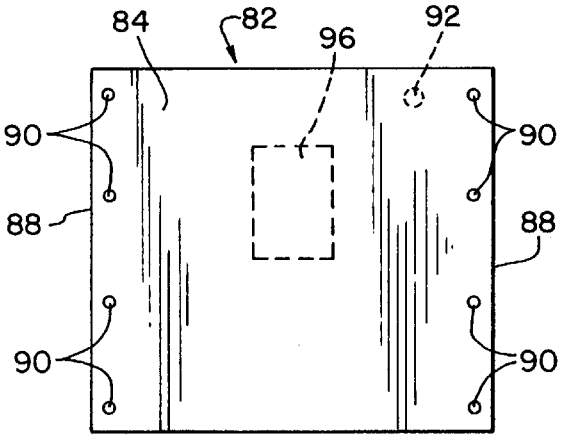
FIG. 4 is a top plan view of a first embodiment of the present invention.
Figure 5:
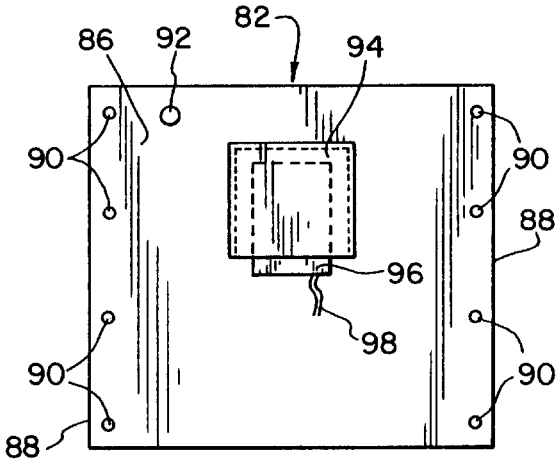
FIG. 5 is a bottom plan view of the embodiment of FIG. 4.

The fluid filled cushion for the seat and back portions discussed above may be provided by structures such as shown in FIGS. 4–7. FIGS. 4 and 5 show a first embodiment of pouch 82 which is particularly adapted to be attached to support bars of a wheelchair frame. Top surface 84 (FIG. 4) and bottom surface 86 (FIG. 5) may be made of vinyl or another water sealed material, and enclose an internal cavity capable of sealingly containing a fluid medium, e.g., water, a water based solution, or other fluid. Opposite edges 88 are capable of attaching to support bars of a wheelchair frame by using grommets 90. Grommets 90 are disposed in openings of pouch 82, and provide a solid collar for a bolt or pin to extend through. Preferably, grommets are comprised of metal, although other suitably strong materials may be utilized.

Top surface 84 serves as a support surface for an individual sitting in a wheel chair, and may be planar or contoured. Preferably, the material of top surface 84 is flexible so that the fluid within pouch 82 may be displaced to achieve the most comfortable sitting position. Bottom surface 86 includes plug 92 and pocket 94. Plug 92 is a resealable entry portal into the internal cavity of pouch 82 which allows for the addition or removal of fluid from within the internal cavity of pouch 82. Pocket 94 serves to locate agitator 96 adjacent to the surface of pouch 82 so that agitator 96 is capable of turbulating and disturbing the fluid within the internal cavity of pouch 82. Agitator 96 may optionally include power wires 98 for connecting to a battery or like power source. Alternatively, batteries or another suitable power source could be incorporated into agitator 96.

Figure 6:
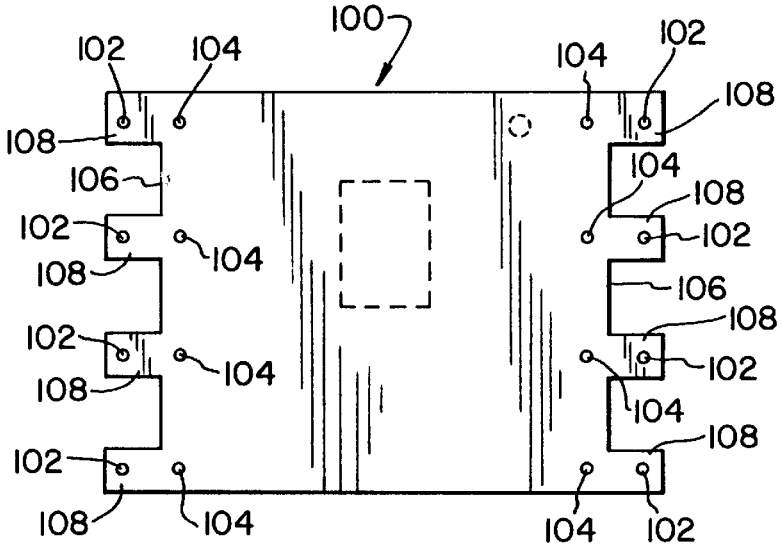
FIG. 6 is a top plan view of a second embodiment of the present invention.
Figure 7:
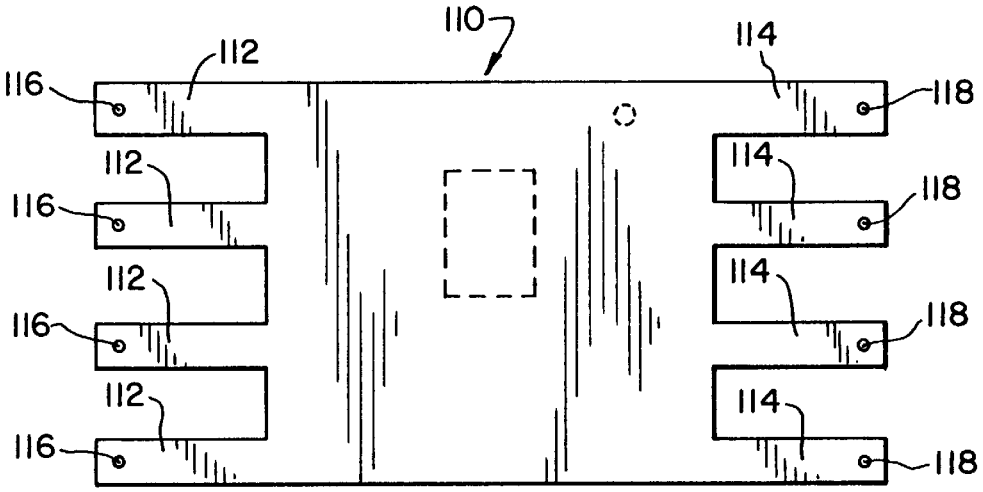
FIG. 7 is a top plan view of a third embodiment of the present invention.

Alternative embodiments of the present invention are shown in FIGS. 6 and 7. Pouch 100 of FIG. 6 has matching pairs of grommets 102, 104 disposed along opposite edges 106. Only the front side of pouch 100 is shown, as the plug and pocket present on the bottom side are similar to those shown in FIG. 5. Edges 106 have a plurality of rectangularly shaped extensions 108. Grommets 102 are disposed within extensions 108 as the outermost grommet of the pair, and grommets 104 are disposed inwardly within the rectangular periphery of pouch 100. Extensions 108 have a sufficient length to extend around the exterior of a wheelchair support bar and allow for grommets 102 and 104 to be aligned. In this manner, a suitable pin, ring, or other connecting device may extend through and connect each pair of grommets 102, 104. Alternatively, snaps or other suitable self attaching elements may be substituted for grommets and the requirement of a third connecting device may thereby be avoided.

The embodiment of FIG. 7 depicts pouch 110 which includes a plurality of oppositely disposed elongate arms 112, 114. Only the front side of pouch 110 is shown, as the plug and pocket present on the bottom side are similar to those shown in FIG. 5. Arms 112 extend from one edge of pouch 110 and include first locking pieces 116. Arms 114 extend from an edge opposite arms 112 and include second locking pieces 118. Arms 112 and 114 have a sufficient length to extend around a seat or structure and place locking pieces 116, 118 in contact so that arms 112 and 114 may be connected together. In this manner, pouch 110 may be connected to structures such as the contoured chair of a scooter or any other structure which would allow arms 112, 114 to extend around its periphery. Alternatively, grommets may be substituted for the locking pieces and a suitable pin, ring, or other connecting device may extend through and connect each pair of grommets.

Thus, the pouch of the present invention may be included with a newly manufactured wheelchair or scooter, or may be retrofitted on an existing structure by addition or substitution. One of ordinary skill would also appreciate that the arm rests and leg rests of the wheelchair or scooter may be equipped with a suitably shaped pouch for a similar effect.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pouch assembly for attaching to a mobile device which supports a nonambulatory individual on a support surface which the individual rests upon, said pouch assemble comprising:

means for defining an internal cavity containing a fluid medium, said defining means including said support surface, said defining means including edges with grommets for attaching to a frame of the mobile device,said pouch assembly including a pocket; and means for agitating the fluid medium in said internal cavity, said agitating means disposed in said pocket and oriented against said internal cavity whereby skin tissue of the individual on said support surface is stimulated to thereby deter the formation of skin sores.

2. The pouch assembly of claim 1 wherein said defining means includes a removably sealable aperture so that fluid may be added or removed from said internal cavity.

3. The pouch assembly of claim 1 further comprising a pair of elongate arms at opposite edges of said pouch, said arms having sufficient length to extend around a seat of the mobile device so that each one of said elongate arms contacts the other of said pair.

4. The pouch assembly of claim 1 wherein said agitating means includes a vibrator contacting said defining means whereby the vibration of the fluid impacts upon and stimulates the skin.

5. In a mobile device for supporting a nonambulatory individual having at least one support surface which the individual rests upon, the improvement comprising:

means for containing a fluid medium, said containing means including said support surface, said containing means including a pouch having an internal cavity, said pouch including edges with grommets for attaching to a frame of the mobile device, said pouch including a pocket; and means for agitating the fluid medium in said containing means, said agitating means disposed in said pocket and oriented against said internal cavity whereby skin tissue of the individual on said support surface is stimulated to thereby deter the formation of skin sores.

6. The mobile device of claim 5 wherein said pouch includes an opening for adding or removing fluid from said internal cavity and means for closing said opening.

7. The mobile device of claim 5 wherein said pouch includes a pair of elongate arms at opposite edges of said pouch, said arms having sufficient length to extend around a seat of the mobile device so that each one of said elongate arms contacts the other of said pair.

8. The mobile device of claim 5 wherein said agitating means includes a vibrator contacting said containing means whereby the vibration of the fluid impacts upon and stimulates the skin.

9. The mobile device of claim 5 wherein said pouch includes a pocket for holding said agitating means.

10. A wheelchair for transporting an individual upon at least one support surface, said wheelchair comprising:

a frame;

a plurality of wheels rotatably supported by said frame;

a pouch defining an internal cavity containing a fluid medium, said pouch including the support surface, said pouch attached to said frame said pouch including a pocket; and a fluid agitator operably associated with the fluid medium in said internal cavity, said fluid agitator disposed in said pocket and oriented against said internal cavity whereby agitation of the fluid causes the skin tissue of the individual on the support surface to be stimulated and thereby deter the formation of skin sores.

11. The wheelchair of claim 10 wherein said frame includes a plurality of support bars, said pouch includes grommets disposed in edge of said pouch, and said grommets of said pouch are engaged with said support bars.

12. The wheelchair of claim 10 wherein said pouch includes an opening for adding or removing fluid from said internal cavity and means for closing said opening.

13. The wheelchair of claim 10 wherein said pouch includes a pair of elongated arms at opposite edges of said pouch, said arms having sufficient length to extend around said frame of said wheelchair so that each one of said elongated arms contacts the other of said pair.

14. The wheelchair of claim 10 wherein said agitator includes a vibrator contacting said pouch whereby the vibration of the fluid impacts upon and stimulates the skin.

15. The wheelchair of claim 10 further comprising a motor drivingly connected to at least one of said wheels.

* * * * *